US007325912B2

(12) United States Patent
Lewey et al.

(10) Patent No.: US 7,325,912 B2
(45) Date of Patent: Feb. 5, 2008

(54) BREACHABLE SEAL

(75) Inventors: William E. Lewey, Albany, OR (US); Eric L. Ahlvin, Corvallis, OR (US); Joseph W. Stellbrink, Lebanon, OR (US); Daniel Fradl, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 317 days.

(21) Appl. No.: 10/960,477

(22) Filed: Oct. 6, 2004

(65) Prior Publication Data

US 2006/0071989 A1 Apr. 6, 2006

(51) Int. Cl.
*B41J 2/175* (2006.01)

(52) U.S. Cl. ..... 347/86; 347/85

(58) Field of Classification Search ..... 347/84, 347/86, 85

See application file for complete search history.

(56) References Cited

U.S. PATENT DOCUMENTS

| | | | | |
|---|---|---|---|---|
| 5,400,573 | A | 3/1995 | Crystal et al. | |
| 5,526,030 | A * | 6/1996 | Baldwin et al. | 347/87 |
| 5,555,007 | A | 9/1996 | Ceschin et al. | |
| 5,802,818 | A | 9/1998 | Doll et al. | |
| 6,031,651 | A * | 2/2000 | Nakasugi | 359/200 |
| 6,086,193 | A * | 7/2000 | Shimada et al. | 347/86 |
| 6,257,711 | B1 * | 7/2001 | Higuma et al. | 347/85 |
| 6,270,204 | B1 * | 8/2001 | Barrett et al. | 347/74 |
| 6,315,392 | B1 * | 11/2001 | Kinas et al. | 347/43 |
| 6,412,905 | B1 * | 7/2002 | Lin | 347/29 |
| 6,877,846 | B2 * | 4/2005 | Fellingham et al. | 347/85 |
| 7,077,514 | B2 * | 7/2006 | Inoue et al. | 347/86 |
| 2002/0097306 | A1 * | 7/2002 | Deshmukh | 347/86 |
| 2002/0122098 | A1 * | 9/2002 | Sekiya | 347/50 |
| 2003/0107626 | A1 * | 6/2003 | Qingguo et al. | 347/86 |
| 2005/0024452 | A1 * | 2/2005 | Steinmetz et al. | 347/86 |
| 2005/0151801 | A1 * | 7/2005 | Neese et al. | 347/85 |

FOREIGN PATENT DOCUMENTS

| | | |
|---|---|---|
| EP | 0 792 749 | 9/1997 |
| GB | 2 350 323 | 11/2000 |
| JP | 09-136426 | 5/1997 |

* cited by examiner

*Primary Examiner*—Stephen Meier
*Assistant Examiner*—Sarah Al-Hashimi

(57) ABSTRACT

In one embodiment, a reservoir for holding a fluid includes a housing defining an enclosed chamber, the housing having a first opening therein at one part of the chamber and a second opening therein at a second part of the chamber above the first part of the chamber, a breachable seal sealing the second opening, and a circuitous tunnel exposing the chamber to the atmosphere through the second opening if the seal is breached.

14 Claims, 10 Drawing Sheets

BREACHABLE SEAL

BACKGROUND

Some inkjet printing systems utilize replaceable ink supply cartridges positioned or carried adjacent to the ink pens to resupply the pens with ink. An ink supply cartridge must be vented to allow ink to flow from the cartridge into the ink pen. The vent on the supply cartridge should be sealed until the ink pen is intentionally resupplied with ink to prevent the stored ink from evaporating or spilling.

DRAWINGS

DESCRIPTION

Embodiments of the present invention were developed in an effort to provide a breachable seal suitable for use sealing the vent on a replaceable ink supply cartridge. Some embodiments of the invention, therefore, will be described with reference to inkjet printing and ink pens. An ink pen is also commonly referred to as an ink cartridge, a print cartridge or an inkjet print head assembly. Embodiments of the invention, however, are not limited to use in inkjet printing, ink pens or with ink. Rather, embodiments of the invention may be used in any application or environment which might benefit from such a seal. The exemplary embodiments shown in the figures and described below illustrate but do not limit the invention. Other forms, details, and embodiments may be made and implemented. Hence, the following description should not be construed to limit the scope of the invention, which is defined in the claims that follow the description.

Figure 1:
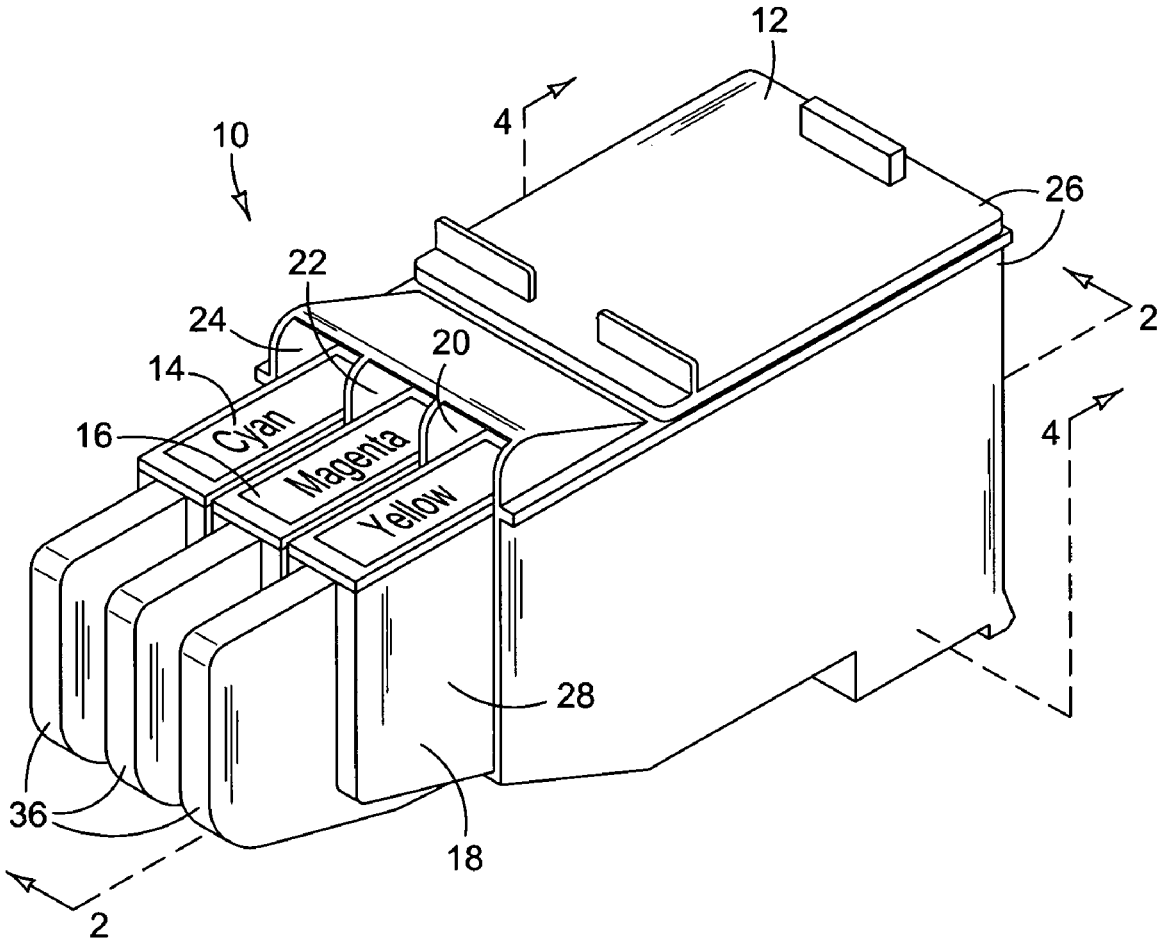
FIG. 1 is a perspective view of an ink pen assembly that includes a color ink pen with attached yellow, magenta and cyan ink supply cartridges.
Figure 2:
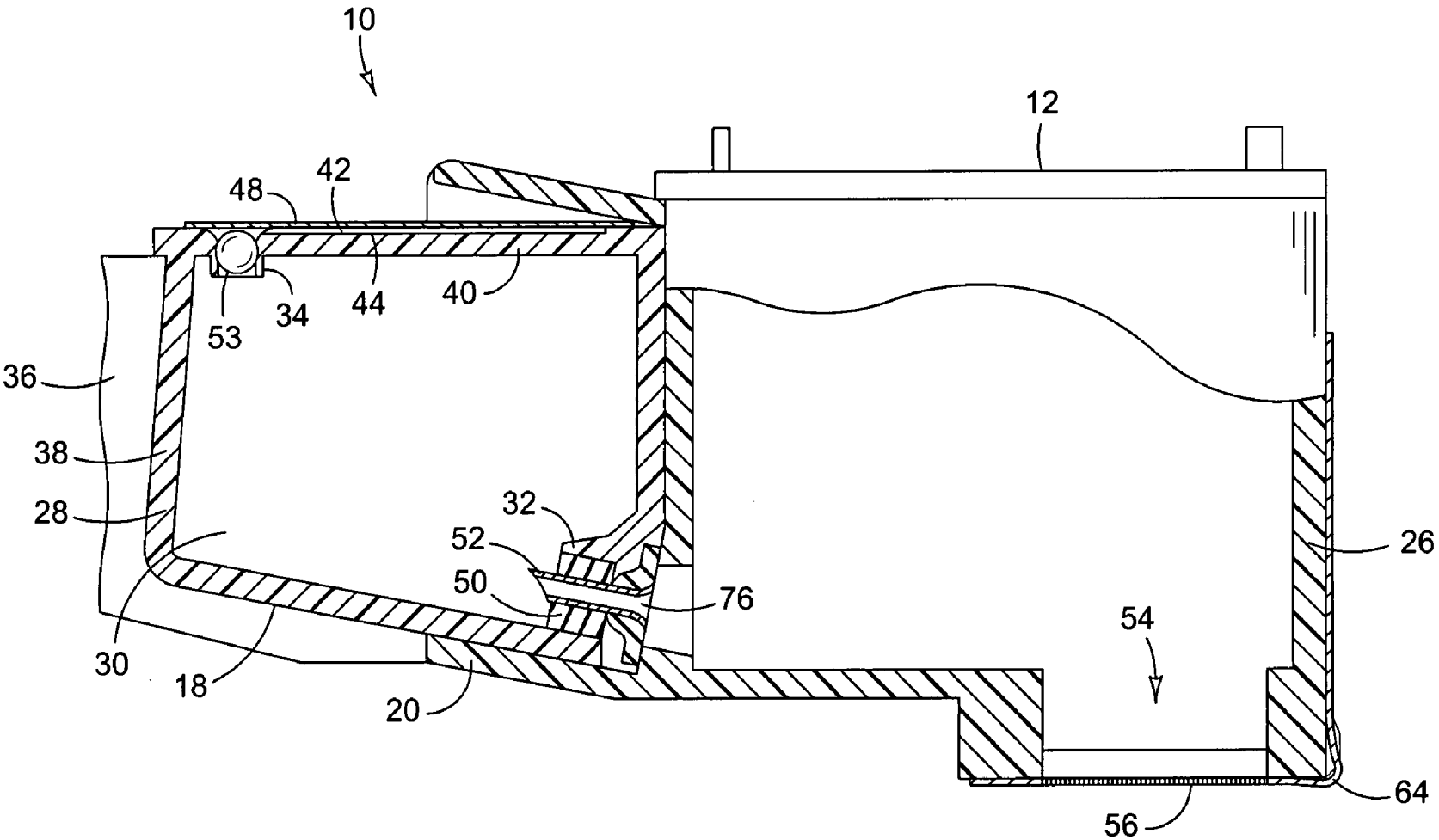
FIG. 2 is a partial section view of the assembly of FIG. 1 taken along the line 2-2 in FIG. 1.
Figure 3:
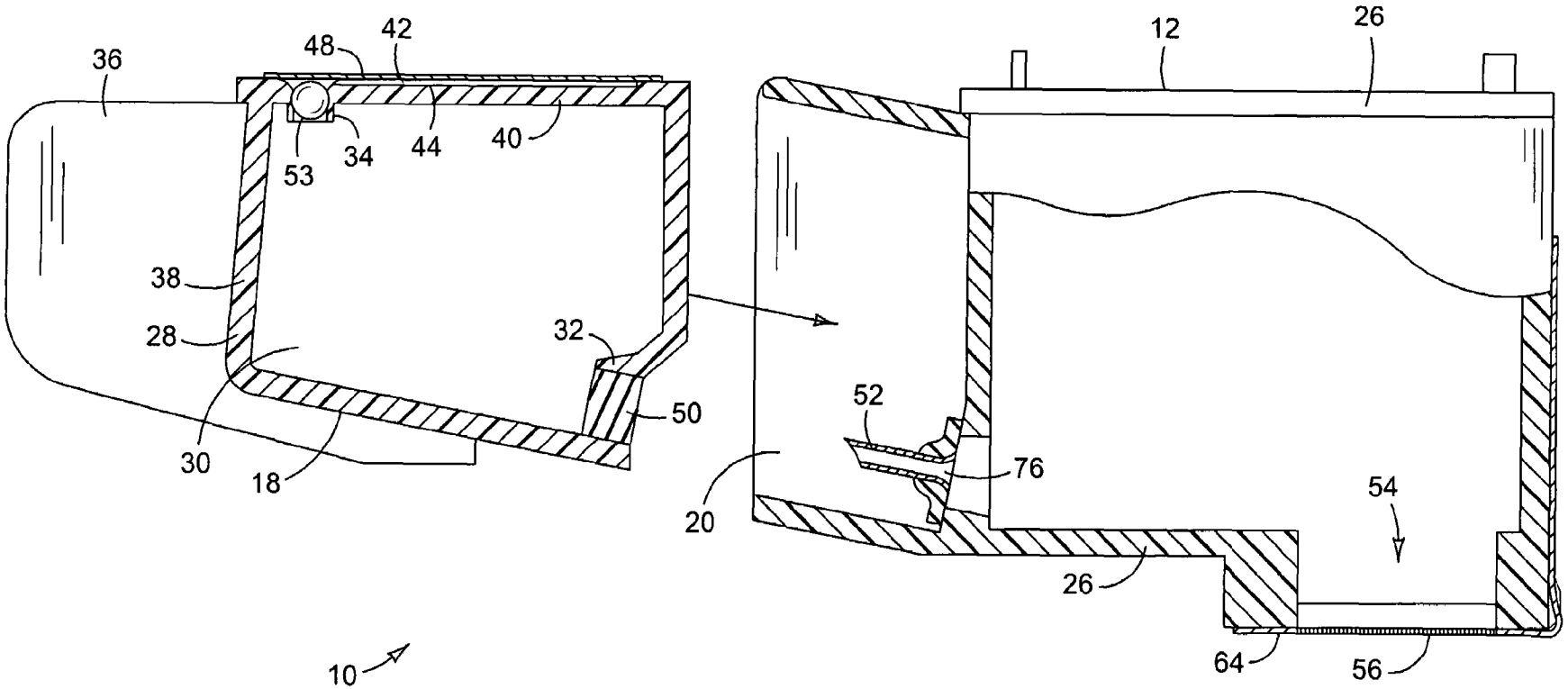
FIG. 3 is a partial section view of the assembly of FIG. 1 showing the ink supply cartridge detached from the ink pen.
Figure 4:
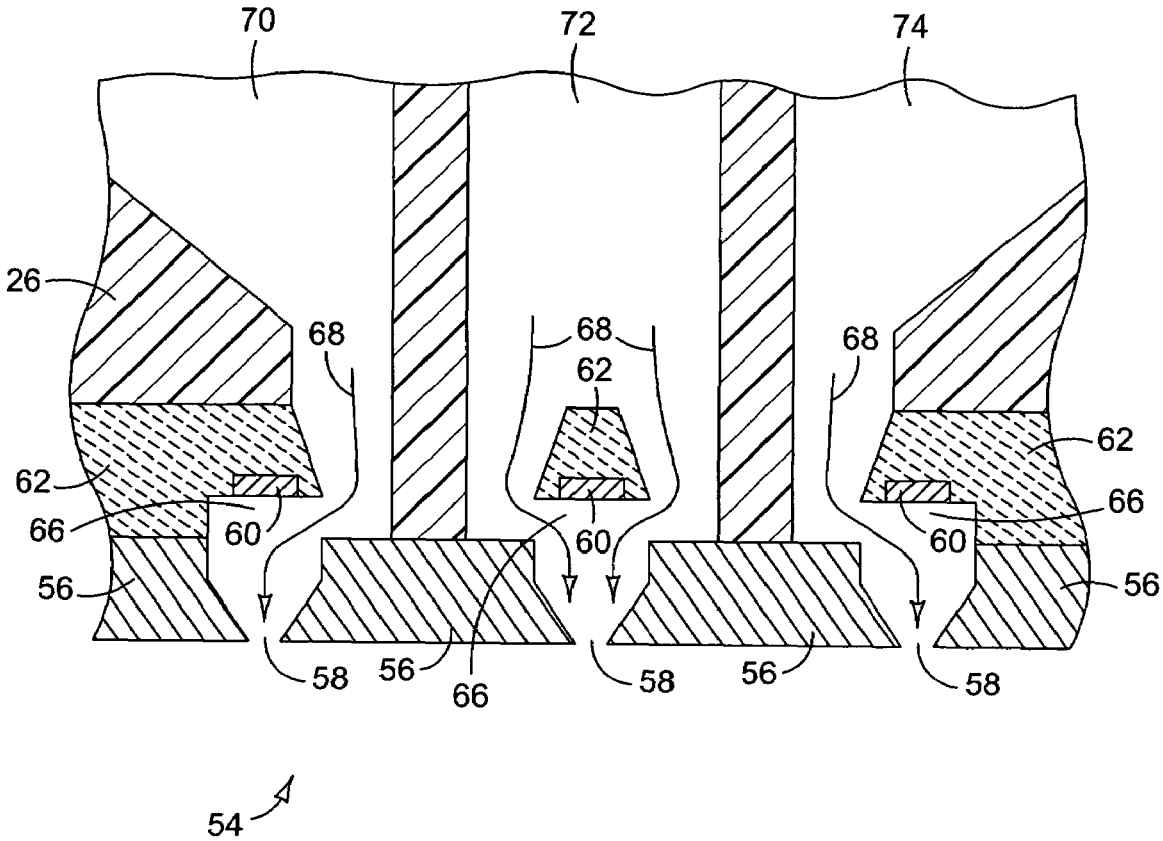
FIG. 4 is a section view of the ink pen of FIG. 1 taken along the line 4-4 in FIG. 1.

FIG. 1 is a perspective view of an ink pen assembly 10 that includes a color ink pen 12 and ink supply cartridges 14, 16 and 18 attached to ink pen 12. Cyan, magenta and yellow in cartridges 14, 16 and 18 are shown in FIG. 1 as one example of the colors used in ink pen 12. FIG. 2 is a side elevation section view of ink pen assembly 10 taken along the line 2-2 through yellow supply cartridge 18 in FIG. 1. FIG. 3 is similar to FIG. 2 except that supply cartridge 18 is detached from ink pen 12. FIG. 4 is a partial front elevation section view showing the ink ejection nozzle area of ink pen 12. The relative scale and dimensions of some of the features of assembly 10 shown in FIGS. 2-4 are greatly adjusted and some conventional features well known to those skilled in the art of inkjet printing have been omitted for clarity.

Referring first to FIGS. 1-3, each supply cartridge 14, 16 and 18 fits into a receiver 20, 22 and 24 extending from housing 26 of ink pen 12. Each cartridge 14, 16 and 18 includes a housing 28 that encloses an ink storage tank 30, an outlet 32 and a vent 34. A flat flange 36 extends to the rear of housing 28 to make it easier for a user to grasp a cartridge 14, 16 or 18 for installation and removal. Outlet 32 is positioned at one extreme of tank 30, the lower right hand corner in the embodiment shown in FIGS. 2 and 3. Vent 34 is positioned at another extreme of tank 30, the upper left hand corner in the embodiment shown in FIGS. 2 and 3. While the position of outlet 32 and vent 34 may vary depending on the particular configuration and/or placement of cartridge 14, 16 or 18, it is expected that outlet 32 typically will be positioned at a lower extreme of tank 30 to allow as much ink as possible to flow out of tank 30 and vent 34 typically will be positioned at an upper extreme of tank 30 above the level of ink in tank 30.

Figure 5:
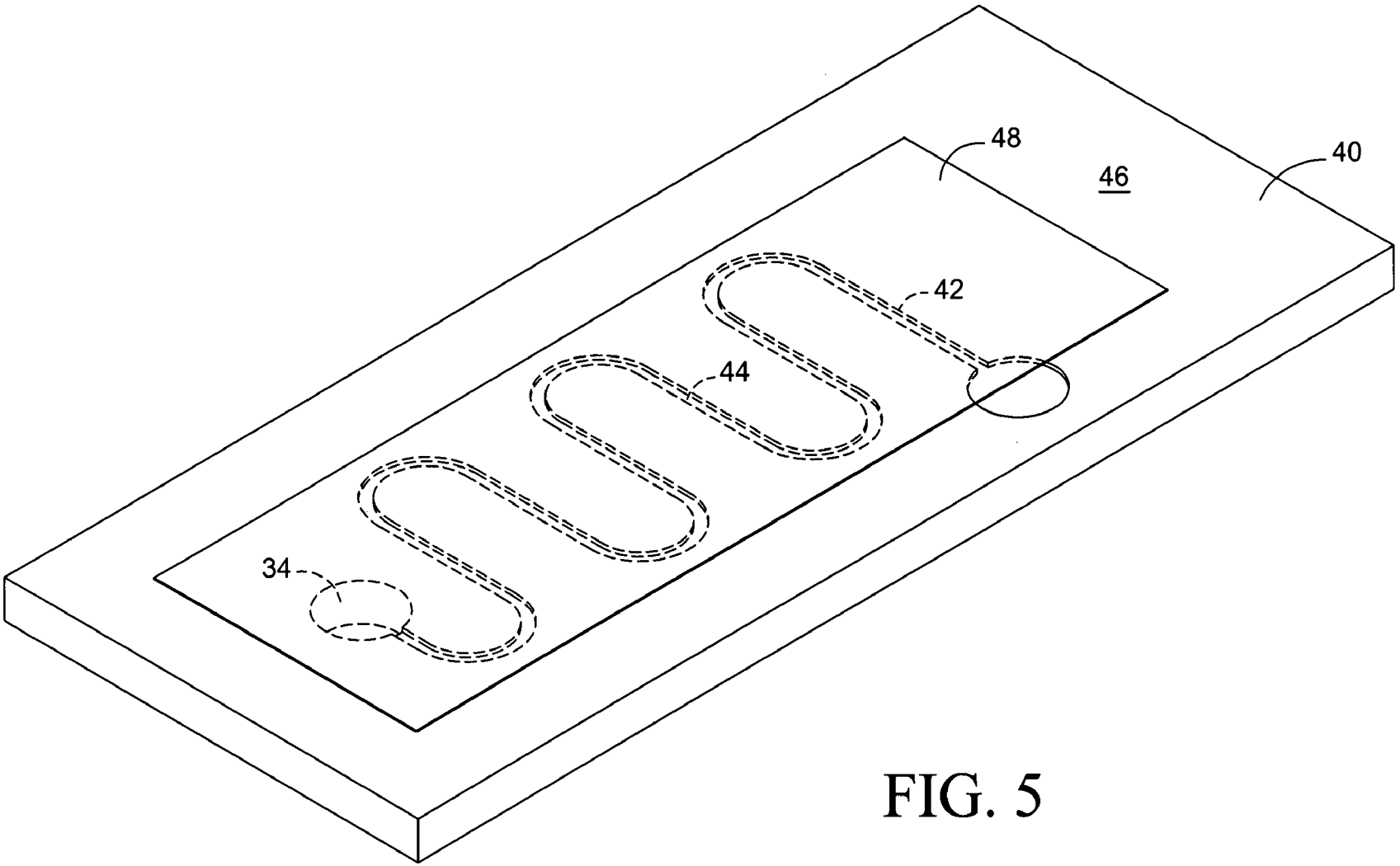
FIG. 5 is a detail perspective view showing a lid for an ink supply cartridge such as the cartridges shown in FIGS. 1-3.

Supply cartridge housing 28 includes a body 38 and a lid 40. Body 38 and lid 40 may be formed as discrete parts affixed to one another or as an integral unit. Vent 34 is formed as an opening in lid 40. One example of a lid 40 is shown in FIG. 5. Referring now also to FIG. 5, vent 34 is exposed to the atmosphere through a circuitous tunnel 42. In some applications for supply cartridge 28, vent 34 may be exposed to the return side of an ink delivery system and allow pumping, remote venting, bleeding or pressurization as well as recirculation. Hence, direct venting to the atmosphere is just one example for vent 34. Tunnel 42, commonly referred to as a labyrinth, is formed by a recess 44 in the top 46 of lid 40 covered by a label or other suitable cover 48. Labyrinths, which are well known in the art of inkjet printing, are commonly used for venting ink pens to slow the rate of evaporation. In the embodiment shown in FIGS. 2 and 3, outlet 32 is sealed with an elastic membrane 50. As shown in FIG. 2, when a supply cartridge 14, 16 or 18 is installed in a receiver 20, 22 or 24, a needle 52 projecting from ink pen housing 26 pierces membrane 50 to provide a pathway for ink to flow from supply cartridge 14, 16 or 18 to ink pen 12. A ball cork seal 53 seals supply cartridge vent 34.

Referring to FIGS. 2-4, a print head 54 is located at the bottom of ink pen 12. Print head 54 includes an orifice plate 56 with ink ejection orifices 58 and firing resistors 60 formed on an integrated circuit chip 62 positioned behind ink ejection orifices 58. A flexible circuit 64 carries electrical traces from external contact pads (not shown) to firing resistors 60. When ink pen 12 is installed in a printer, pen 12 is electrically connected to the printer controller through the contact pads. In operation, the printer controller selectively energizes firing resistors 60 through the signal traces in flexible circuit 64. When a firing resistor 60 is energized, ink in a vaporization chamber 66 next to a resistor 60 is vaporized, ejecting a droplet of ink through orifice 58 on to the print media. Vaporization chamber 66 then refills with ink from ink reservoirs 70, 72 or 74 in preparation for the next ejection. The flow of ink through print head 54 is illustrated by arrows 68 in FIG. 4. Each ink reservoir 70, 72 and 74 can be resupplied with ink from the respective supply cartridge 14, 16 or 18 through needle 52 at inlet port 76 in each reservoir 70, 72 and 74. Breaching vent seal 53 on a supply cartridge 14, 16 or 18 allows ink to flow from the supply cartridge 14, 16 or 18 into the respective reservoir 70, 72 or 74.

Figure 6:
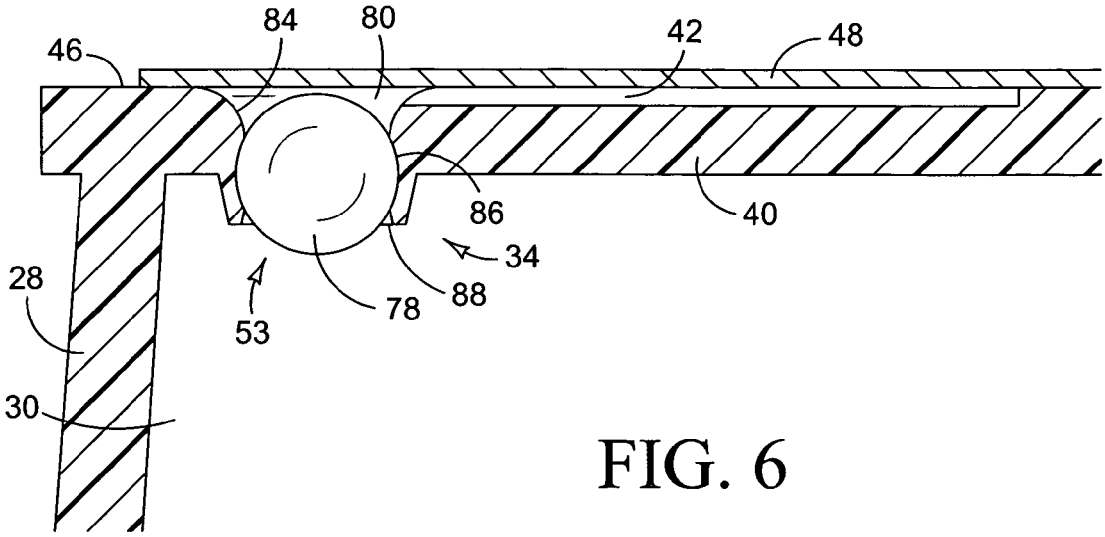
FIGS. 6-8 are section views showing in more detail the vent seal in the cartridge of FIGS. 2 and 3.
Figure 7:
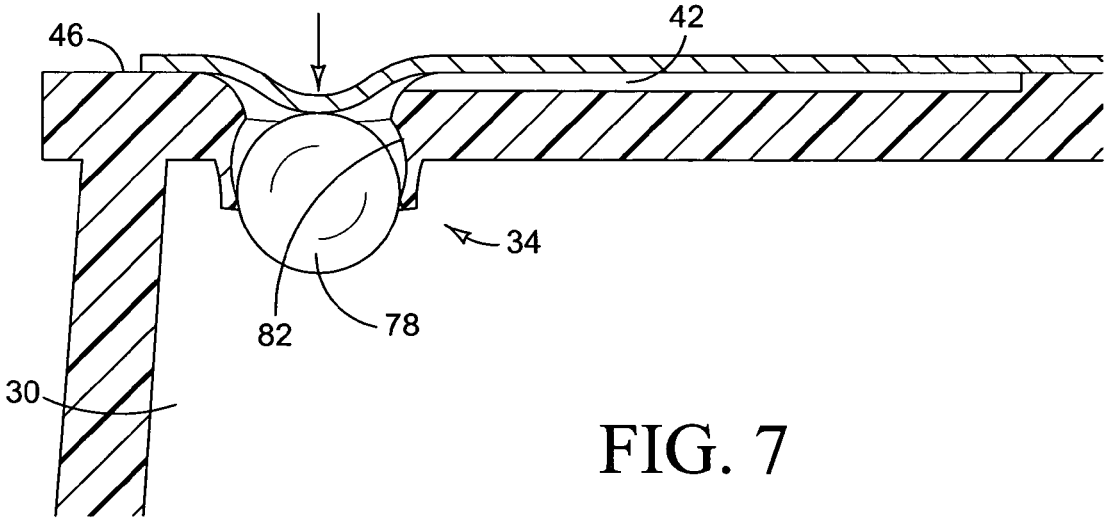
Figure 8:
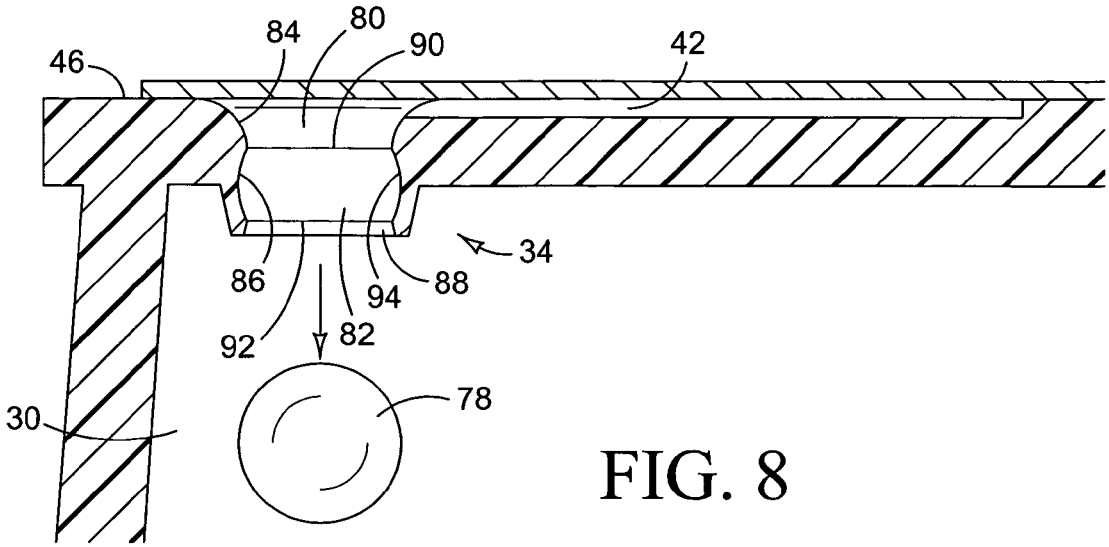

FIGS. 6-8 illustrate one embodiment of a ball cork seal 53 in more detail. Referring to FIGS. 6-8, a ball 78 is pressed into a circular opening 80 that forms vent 34 in lid 40 of cartridge housing 28. Opening 80 is defined by a sidewall 82 that includes a lead-in 84, a ball seat 86 and a lead-out 88.

Lead-in 84 tapers down to a sharp upper edge 90 of ball seat 86. A sharp upper edge 90 helps stop capillary travel of ink meniscus from tank 30 to tunnel 42. Lead-out 88 tapers out from a sharp lower edge 92 of ball seat 86. Opening 80 is configured to make the force needed to push ball 78 into ball seat 86 greater and the force needed to push ball 78 down out of ball seat 86 lesser. For example, the diameter of opening 80 at upper edge 90 is made smaller to make the force needed to push ball 78 past upper edge 90 fully into ball seat 86 greater and the diameter of opening 80 at lower edge 92 is made larger to make the force needed to push ball 78 past lower edge 92 out of ball seat 86 less than the force need to push ball 78 back past upper edge 90. A sharp lower edge 92 also helps stop capillary travel of ink meniscus from tank 30 into ball seat 86. Lead-out 88 is configured to squeeze ball 78 out of opening 80 once the diameter of ball 78 has passed lower edge 92 by, for example, allowing the lower part of sidewall 82 to flex as ball 78 is pushed out of seat 86. A radiused lip (not shown) on the bottom of lead-out 88 helps reduce the meniscus force from any ink meniscus that forms. Outside wall 94 tapers down at lead-out 88 to make the exit cross-section of sidewall 82 weaker at lower edge 92 and lead-out 88.

The face 94 of ball seat 86 is spherical with a diameter slightly smaller than the diameter of ball 78 to help ensure a good seal force from an interference fit between ball 78 and face 94. Ball seat 86 is positioned so that ball 78 is just below the plane of top 46 of lid 40. Ball cork seal 53 is breached to vent tank 30 by pressing down on cover 48 until ball 78 pops out of opening 80, as shown in FIGS. 7 and 8. The relative geometries of ball 78 and the pertinent features of opening 80 are determined, at least in part, to minimize the length of the stroke needed to push ball 78 down and out of ball seat 86.

Figure 9:
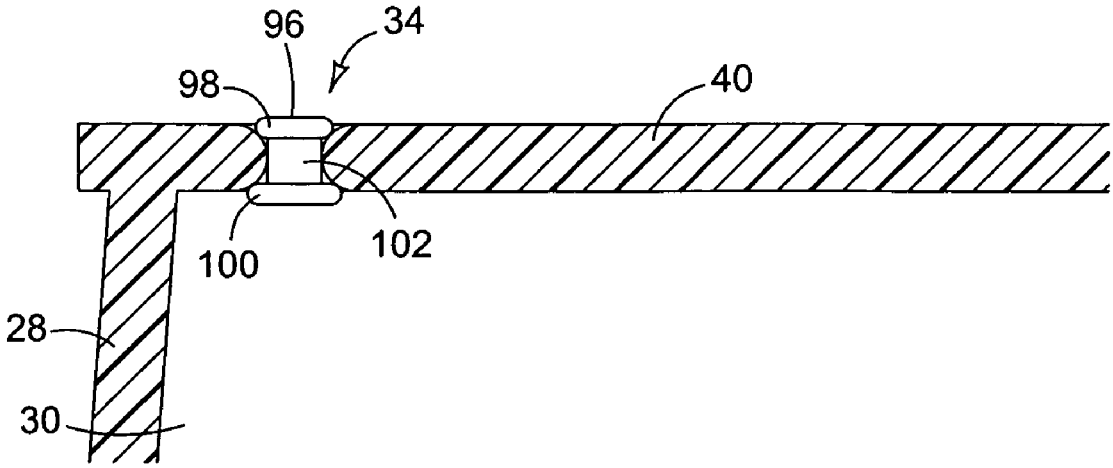
FIGS. 9-10, 11-12, 13-14 and 15-16 are section views showing examples of other vent seals that might be used in an ink supply cartridge like the one shown in FIGS. 2 and 3.
Figure 10:
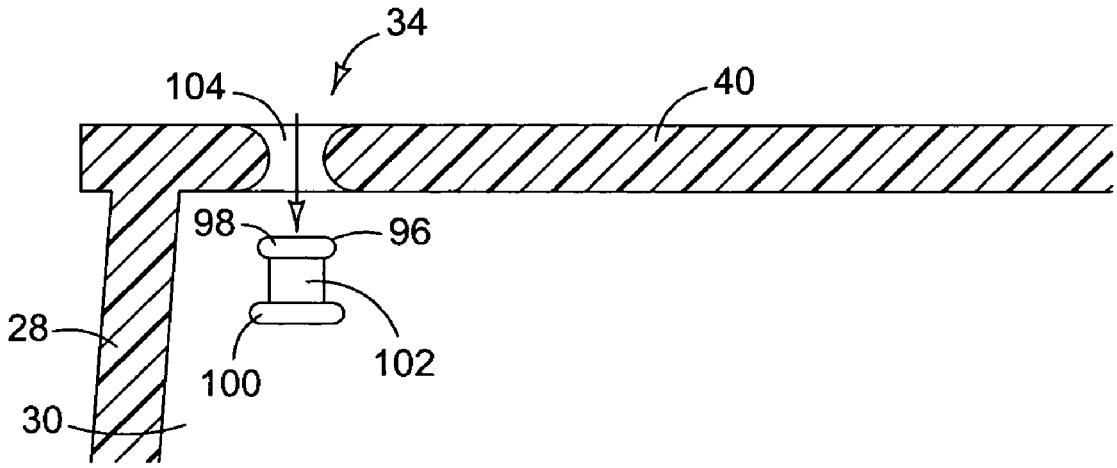

FIGS. 9 and 10 illustrate another embodiment of a breachable seal 96 such as might be used to seal vent 34 in supply cartridges 14, 16 and 18. Referring to FIGS. 9 and 10, seal 96 is constructed as a generally "dumbbell" shaped plug that includes a top flange 98 and a bottom flange 100 extending from a body 102. Bottom flange 100 extends out from body 102 more than top flange 98 so that the force needed to push plug 96 into tank 30 is lower than the force need to push plug back out of opening 104 in lid 40.

Figure 11:
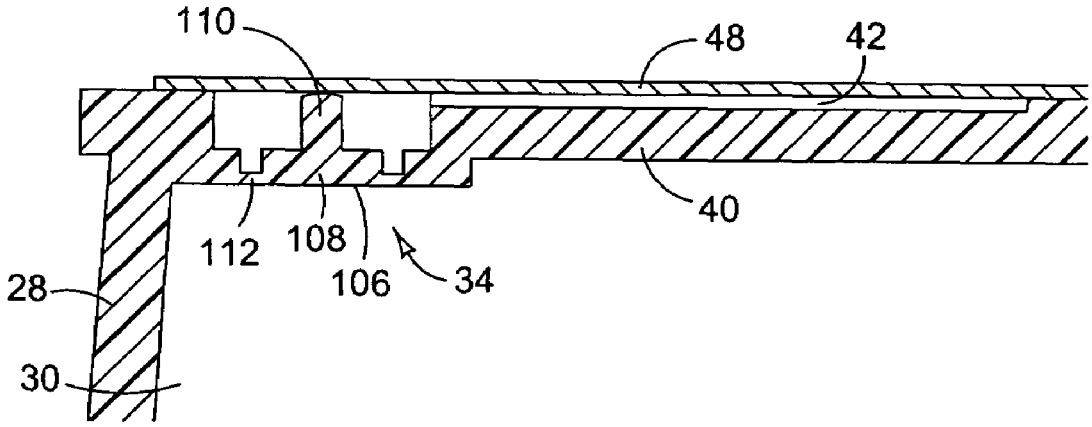
Figure 12:
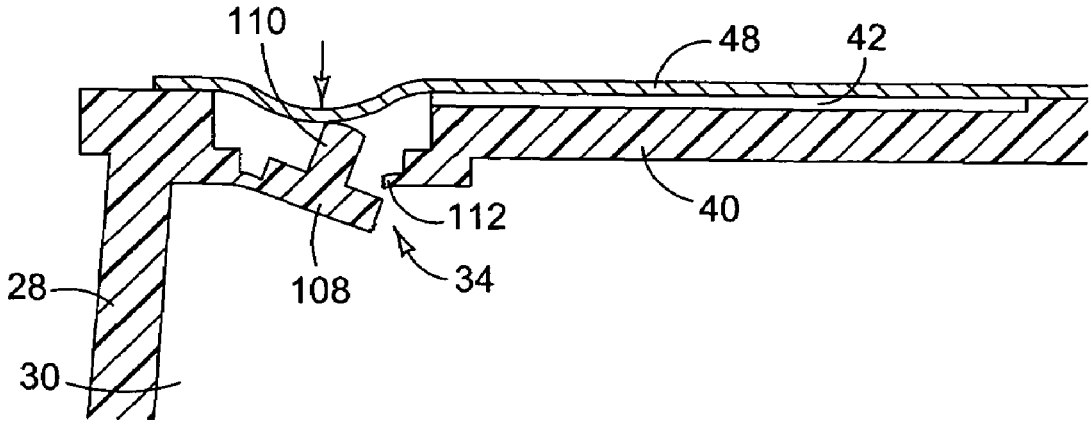

FIGS. 11 and 12 illustrate another embodiment of a breachable seal 106 such as might be used to seal vent 34 in supply cartridges 14, 16 and 18. Referring to FIGS. 11 and 12, seal 106 is constructed as a weakened "break-out section" 108 of lid 40. Break-out section 108 includes a post 110 and a narrow neck 112. Post 110 extends to or near top 46 of lid 40 and is positioned generally at the center of section 108 surrounded by neck 112 (or between neck portions 112 if the neck is not continuous). Seal 106 is breached by pressing cover 48 into post 110 to break neck 112 and expose tank 30 to the atmosphere through tunnel 42.

Figure 13:
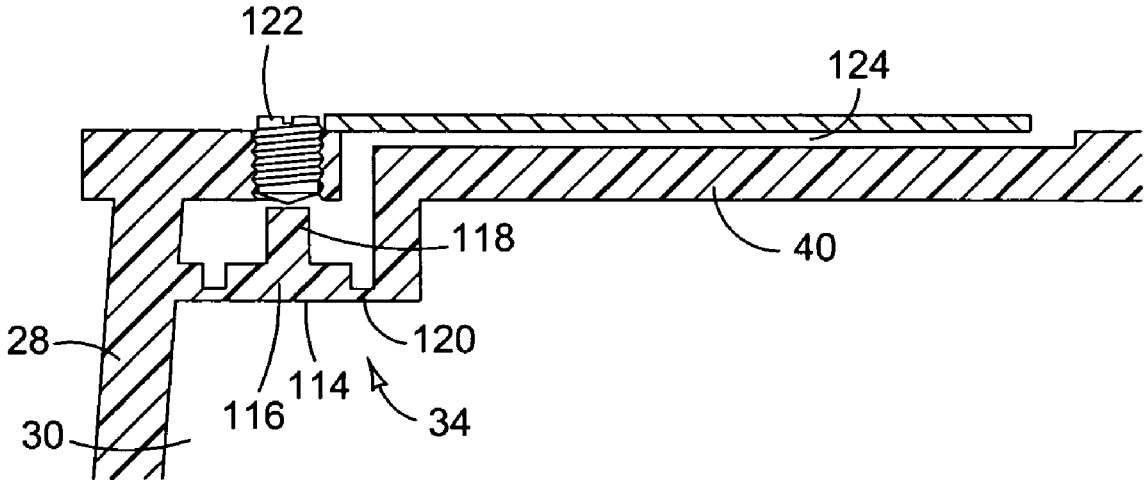
Figure 14:
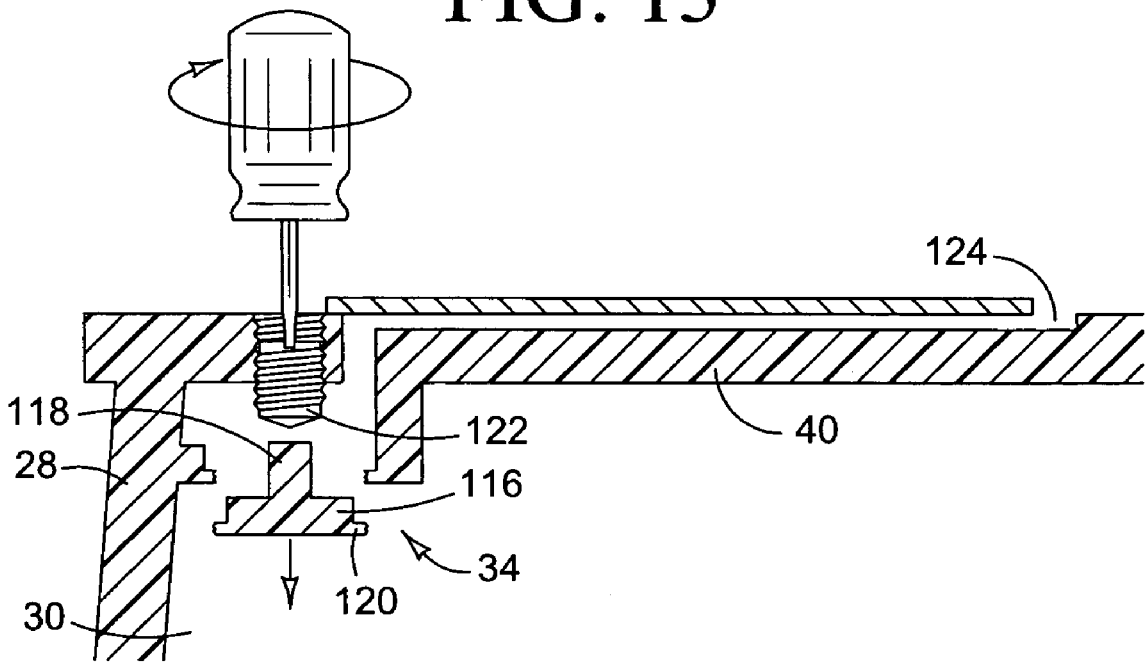

FIGS. 13 and 14 illustrate another embodiment of a breachable seal 114 such as might be used to seal vent 34 in supply cartridges 14, 16 and 18. Referring to FIGS. 13 and 14, seal 114 is constructed as a weakened "break-out section" 116 of lid 40. Break-out section 116 includes a post 118 and a narrow neck 120. A screw 122 threaded into lid 40 over post 118 is used to breach seal 114. Seal 114 is breached by turning screw 122 into post 118 to break neck 120 and expose tank 30 to the atmosphere through a tunnel 122 formed along the interior of lid 40.

Figure 15:
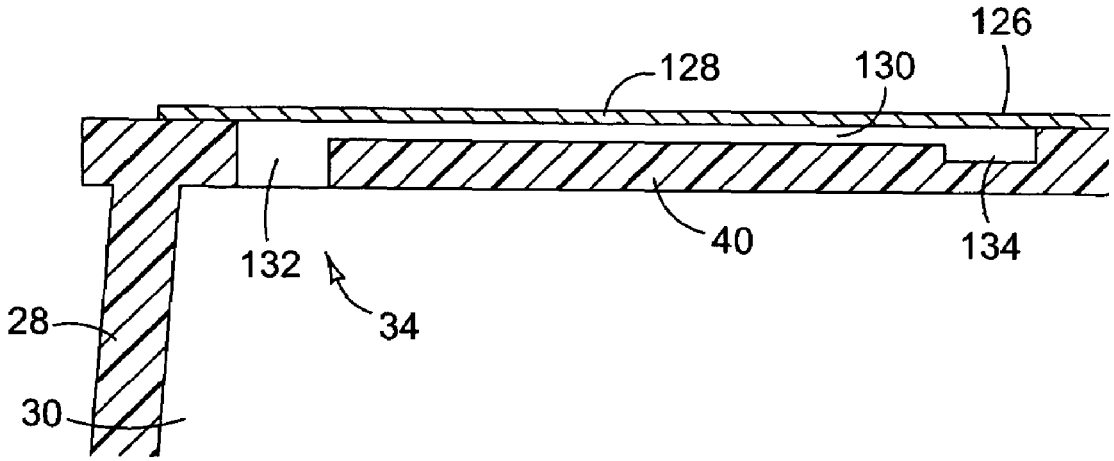
Figure 16:
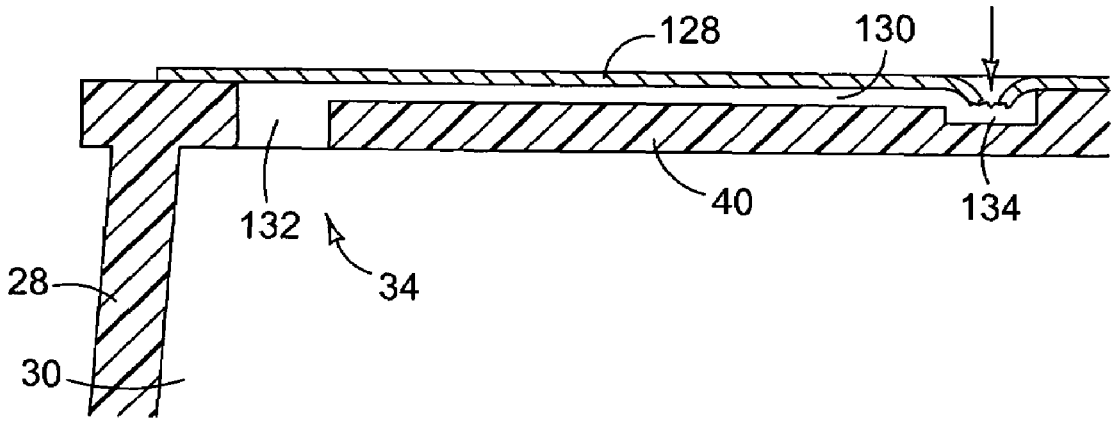

FIGS. 15 and 16 illustrate another embodiment of a breachable seal 126 such as might be used to seal vent 34 in supply cartridges 14, 16 and 18. Referring to FIGS. 15 and 16, seal 126 is constructed as a perceivable label or other cover 128 over a tunnel 130 that extends away from opening 132 in lid 40. Seal 126 is breached by piercing cover 128 to expose tank 30 to the atmosphere through tunnel 130. A deeper part 134 of tunnel 130 may be formed at the desired location for piercing cover 128 as necessary or desirable to facilitate breaching cover 128.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A reservoir for holding a fluid, comprising:

a housing defining an enclosed chamber, the housing having a first opening therein at one part of the chamber and a second opening therein at a second part of the chamber above the first part of the chamber;

a breachable seal sealing the second opening, the breachable seal comprising a plug plugging the second opening, the plug configured so that a first force is needed to push the plug into the second opening and a second force lesser than the first force is needed to push the plug out of the second opening; and a circuitous tunnel exposing the chamber to an atmosphere through the second opening if the seal is breached.

2. The reservoir of claim 1, wherein the plug plugging the second opening comprises a ball seated in the second opening.

3. The reservoir of claim 1, wherein the plug plugging the second opening comprises a generally dumbbell shaped plug having a first flange protruding from one end of a body and a second flange larger than the first flange protruding from another end of the body.

4. A reservoir for holding a fluid, comprising:

a housing defining an enclosed chamber, the housing having a first opening therein at one part of the chamber and a second opening therein at a second part of the chamber above the first part of the chamber;

a breachable seal sealing the second opening, the breachable seal comprising a part spanning the second opening, the part having a post extending to near a top of the second opening at an interior of the part and a thin easily breakable neck at an exterior of the part; and a circuitous tunnel exposing the chamber to an atmosphere through the second opening if the seal is breached.

5. A seal, comprising:

a passage;

a ball blocking the passage;

a first narrower portion of the passage on one side of the ball;

a second narrower portion of the passage on another side of the ball;

the first narrower portion configured so that a first force is needed to push the ball past the first narrower portion of the passage; and the second narrower portion configured so that a second force lesser than the first force is needed to push the ball past the second narrower portion of the passage.

6. A seal, comprising:

a passage having a sidewall defining a seat; and a ball seated in the seat, the ball and the sidewall of the passage configured relative to one another so that a first force is needed to seat the ball in the seat and a second force greater than the first force is needed to unseat the ball from the seat.

7. A seal, comprising:

a passage;

a ball seated in a seat in the passage;

a first rigid taper leading in to the seat; and a second flexible taper leading out of the seat.

8. A seal, comprising:

a passage;

a ball seated in a seat in the passage;

a first taper leading in to the seat;

a second taper leading out of the seat;

a first edge at an intersection of the first taper and the ball seat; and a second edge at an intersection of the second taper and the ball seat.

9. An ink pen assembly, comprising:

an ink pen having an ink reservoir and a print head operatively connected to the ink reservoir; and a supply cartridge removably connected to the ink pen so that ink may flow from the supply cartridge to the ink reservoir, the supply cartridge comprising a housing defining an enclosed chamber, the housing having a first opening at the top of the housing and a second opening at a bottom of the chamber, a breachable seal sealing the first opening, the breachable seal including a plug plugging the second opening, the plug configured so that a first force is needed to push the plug into the second opening and a second force lesser than the first force is needed to push the plug out of the second opening, and a circuitous tunnel exposing the chamber to an atmosphere through the first opening if the seal is breached.

10. An ink pen assembly, comprising:

an ink pen having an ink reservoir and a print head operatively connected to the ink reservoir; and a supply cartridge removably connected to the ink pen so that ink may flow from the supply cartridge to the ink reservoir, the supply cartridge comprising an enclosed tank;

an outlet to the ink reservoir at one part of the tank;

a vent at another part of the tank;

a breachable seal sealing the vent, the breachable seal including a part spanning the vent, the part having a post extending to near a top of the vent at an interior of the part and a thin easily breakable neck at an exterior of the part; and a circuitous tunnel exposing an interior of the tank to an atmosphere through the vent if the seal is breached.

11. An ink pen assembly, comprising:

an ink pen having an ink reservoir and a print head operatively connected to the ink reservoir; and a supply cartridge removably connected to the ink pen so that ink may flow from the supply cartridge to the ink reservoir, the supply cartridge comprising an enclosed tank;

an outlet to the ink reservoir at one part of the tank;

a vent at another part of the tank;

a breachable seal sealing the vent, the seal comprising a passage, a ball seated in a seat in the passage, a first taper leading in to the seat, a second taper leading out of the seat, a first edge at an intersection of the first taper and the ball seat, and a second edge at an intersection of the second taper and the ball seat.

12. An ink pen assembly, comprising:

an ink pen having a body defining a plurality of internal reservoirs for storing ink and a print head operatively connected to the reservoirs;

a plurality of ink supply cartridges arranged next to one another across one side of the ink pen opposite the print head, each supply cartridge removably connected to the ink pen so that ink may flow from the supply cartridge to a corresponding ink reservoir, and each supply cartridge having an enclosed tank for holding ink, a vent to the tank and a breachable seal sealing the vent, the breachable seal including a plug plugging the vent, the plug configured so that a first force is needed to push the plug into the vent and a second force lesser than the first force is needed to push the plug out of the vent.

13. The assembly of claim 12, further comprising a plurality of receivers extending out from the ink pen body for receiving each supply cartridge.

14. The assembly of claim 13, wherein each receiver is formed as an extension of the ink pen body.

* * * * *

UNITED STATES PATENT AND TRADEMARK OFFICE

CERTIFICATE OF CORRECTION

PATENT NO. : 7,325,912 B2
APPLICATION NO. : 10/960477
DATED : February 5, 2008
INVENTOR(S) : William E. Lewey et al.

It is certified that error appears in the above-identified patent and that said Letters Patent is hereby corrected as shown below:

In column 4, line 1, delete “perceivable” and insert -- pierceable --, therefor.

Signed and Sealed this

Fifth Day of August, 2008

JON W. DUDAS
*Director of the United States Patent and Trademark Office*